United States Patent [19]

Kershner et al.

[11] 4,210,307

[45] Jul. 1, 1980

[54] PRE-FIXING HANGER FOR INSULATING SIDE BOARD

[75] Inventors: Stuart D. Kershner, Bethany, Conn.; Ken P. Smith, Warranwood,, Australia

[73] Assignee: Olin Corporation, New Haven, Conn.

[21] Appl. No.: 922,933

[22] Filed: Jul. 10, 1978

[51] Int. Cl.[2] ..... B22D 7/10

[52] U.S. Cl. ..... 249/202; 249/198

[58] Field of Search ..... 164/137, 339, 412; 249/106, 197, 198, 202, 112, 213, 215; 52/698; 269/53

[56] References Cited

U.S. PATENT DOCUMENTS

| | | | |
|---|---|---|---|
| 929,688 | 8/1909 | Monnot | 249/106 |
| 1,137,264 | 4/1915 | Gathmann | 249/106 |
| 3,737,138 | 6/1973 | Gregan | 249/197 |
| 4,074,844 | 2/1978 | Hodil, Jr. | 227/8 |
| 4,083,528 | 4/1978 | Anthony, Jr. et al. | 249/198 |

FOREIGN PATENT DOCUMENTS

| | | | |
|---|---|---|---|
| 257393 | 4/1964 | Netherlands | 249/198 |
| 301277 | 6/1971 | U.S.S.R. | 249/112 |

*Primary Examiner*—Robert D. Baldwin
*Assistant Examiner*—K. Y. Lin
*Attorney, Agent, or Firm*—Paul J. Lerner; William W. Jones

[57] ABSTRACT

A device and method for temporarily supporting a metallurgical side board in a predetermined position against a vertical surface of an ingot mold, comprising an attachment member, adapted for releasable attachment to a side board, connected to a counterbalance body by a chain. The point of attachment of the chain to the attachment member is offset, relative to the center of gravity of a side board attached thereto, whereby a component of the gravitational force acting on the side board presses the same against the vertical surface of the mold.

1 Claim, 4 Drawing Figures

PRE-FIXING HANGER FOR INSULATING SIDE BOARD

BACKGROUND AND SUMMARY OF THE INVENTION

The present invention relates to metal founding and more particularly, to a device for use in lining of ingot mold surfaces.

It is common practice, in the process of metal ingot casting, to attach insulating side boards to the inner surfaces of the ingot mold, near the mold mouth. This was formerly accomplished by one or more workmen who climbed into the large, cylindrical mold, manually held the individual side boards in the desired positions, and mechanically fastened them in place.

This procedure has been modified somewhat by the introduction of a specially designed powder actuated tool, described in U.S. Pat. No. 4,074,844, which allows a workman to stand on the top edge of the mold while setting the fasteners which secure the insulating boards to the mold walls. However, temporary retention of the boards, during the fastening process, still requires a second workman to manually hold the individual boards or the use of some kind of awkward jury-rigged support. Neither of these measures is satisfactory due to their undue cost.

The present invention comprises a device for temporarily supporting a side board in a predetermined position against a vertical surface of an ingot mold.

The device comprises, in general, an attachment member, adapted for releasable attachment to a side board and a counterbalance body connected to the attachment member by a chain. More specifically, the point of attachment of the chain to the attachment member is offset, relative to the center of gravity of a side board attached thereto, whereby the device may be arranged such that a component of the gravitational force acting on the side board presses the same against a vertical surface of the ingot mold.

The method of using the device comprises, in general, the steps of releasably fastening a chain to the side board, along the longitudinal axis thereof, placing the side board in the desired position against a vertical surface of the ingot mold, draping the chain over the top of the ingot mold wall, and suspending a counterbalance weight from the free end of the chain. More specifically, the method includes the further steps of offsettingg the point of attachment of the chain, relative to the center of gravity of the side board, and disposing the side board with the attachment point between the vertical mold surface and the center of gravity.

DESCRIPTION OF THE PREFERRED EMBODIMENT

Figure 1:
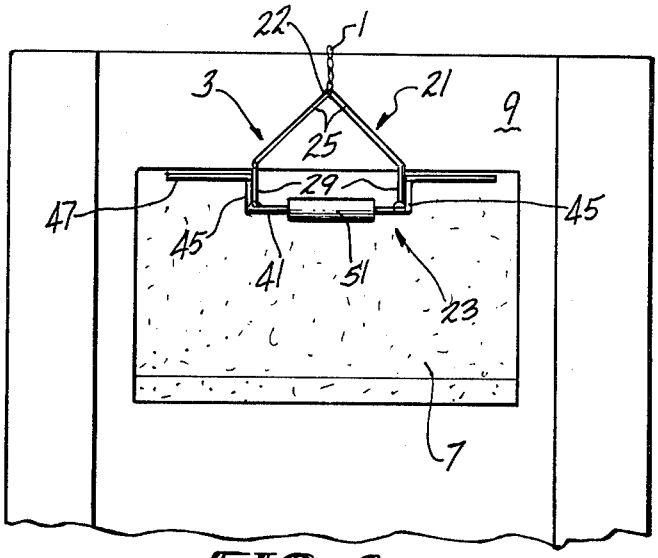
FIG. 1 is a front plan view of a suspension device arranged and constructed in accord with the present invention.
Figure 2:
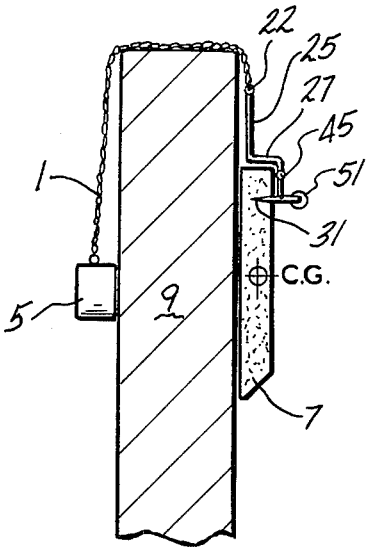
FIG. 2 is a side plan view of the device of FIG. 1.
Figure 3:
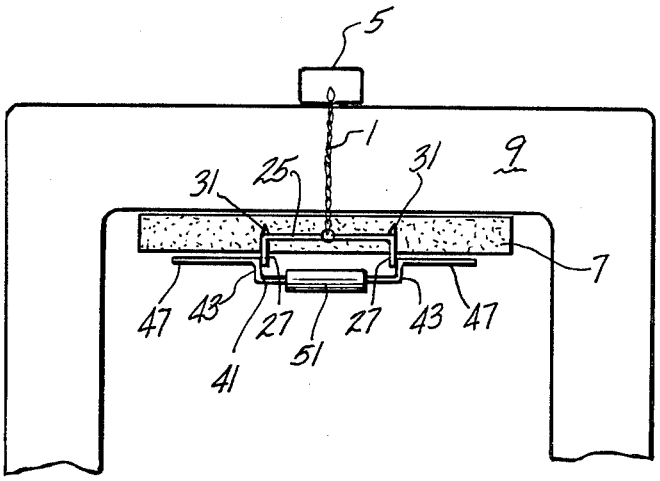
FIG. 3 is a top plan view of the device of FIGS. 1 and 2.
Figure 4:
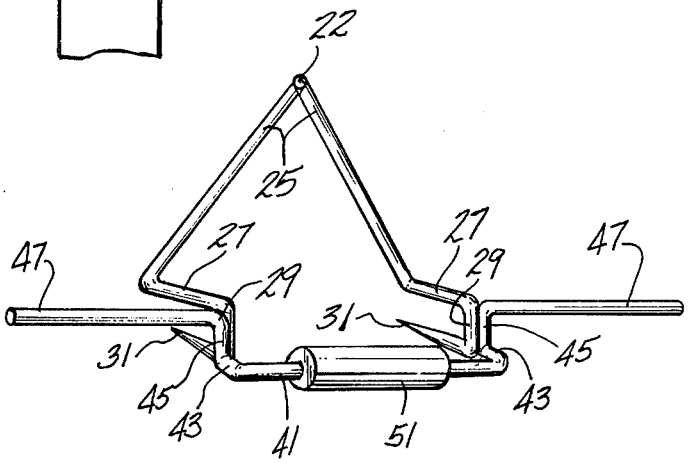
FIG. 4 is a perspective view of the device of FIGS. 1-3.

As shown in the drawing, the suspension device of the present invention comprises a chain, cable or similar flexible member 1 extending between at attachment member 3 and a counterbalance body 5.

The attachment member 3, which is adapted for releasable attachment to an insulation side board 7, includes two components, a hanger/spike element 21 and a handle/guide element 23, both of which may be conveniently formed of metal rod, such as welding rod, of ⅛ to 5/16 inches in diameter.

The hanger/spike element 21 comprises an attachment point 22 from which depend planarly disposed diverging arms 25. From the spaced ends of the arms 25, extend first members 27 perpendicular to the plane of the arms 25 and of a length substantially equal to the thickness of a side board 7. Pointed spikes 31, disposed parallel to the first members 27, are joined thereto by parallel second members 29 lying in a plane parallel to the plane of the arms 25.

The handle/guide element 23 comprises a cross member 41 from which extend parallel first portions 43 disposed perpendicular thereto. Parallel second portions 45, perpendicular to both the first portions 43 and the cross member 41, join colinear guide members 47 to the first portions 43. The second portions 45 are slightly shorter than the second members 29. The distal ends of the guide members 47 are spaced apart a distance slightly less than the width of a side board 7.

The elements 21 and 23 are joined, preferably by welding, with the second members 29 lying parallel to and closely adjacent the second portions 45 and being fastened thereto, and the arms 25 and the guide members 45 lying in a common plane. A convenient handle 51 is centered on the cross member 41.

The counterbalance body 5 is approximately equal in weight to the combination of the attachment member 3 and a side board 7.

In use, the attachment member 3 is disposed along the longitudinal axis of a side board 7, with the first members 27 beyond the board edge. The presence of the guide members 47 provides visual cues to facilitate proper placement. Once properly placed, pressure on the handle 51 drives the spikes 31 into the side board 7, securing the attachment member 3 thereto.

The side board 7 is now positioned as desired against a vertical surface of an ingot mold, with the attachment point 23 in contact with the mold wall 9, and the chain 1 is draped over the top of the mold wall 9. The board 7 is thus balanced by the counterbalance body 5. Further, the attachment point 22 lies between the center of gravity of the side board 7 and the ingot wall surface. Thus, a component, of the gravitational force acting on the side board 7, presses the same against the mold surface and tends to prevent undesired movement thereof.

After permanent fastening of the side board 7, as by means of the tool disclosed in the aforementioned U.S. Pat. No. 4,074,844, the attachment member is removed by pulling on the handle 47.

Since many changes and variations of the disclosed embodiment of the invention may be made without departing from the inventive concept, it is not intended to limit the invention otherwise than as required by the appended claims.

We claim:

1. A device for temporarily supporting a metallurgical side board in a predetermined position against a vertical surface of an ingot mold, said device comprising a spiked attachment member adapted for releasable impalement in a side board, a counterbalance body approximately equal in weight to the combination of said attachment member and a side board, and a flexible member connecting said counterbalance body and said attachment member, said attachment member including a pair of linear, transversely extending guide members providing visual cues facilitating placement of said attachment member along the longitudinal axis of a side board, the point of attachment of said flexible member to said attachment member is offset, relative to said guide members, whereby the device may be arranged such that a component of the gravitational force acting on an impaled side board urges the same against a vertical surface of a supporting ingot mold, said attachment member further comprising a handle portion, offset relative to said guide members on the side thereof opposite said point of attachment, and at least two spikes disposed perpendicular to the plane of said guide members, said spikes being adapted to be driven into a side board by pressure on said handle member.

* * * * *